US006627877B1

(12) United States Patent
Davis et al.

(10) Patent No.: US 6,627,877 B1
(45) Date of Patent: Sep. 30, 2003

(54) TIME OF FLIGHT ANALYSIS DEVICE

(75) Inventors: Stephen C Davis, Manchester (GB); Dmytro Bandura, Dandenong (AU); Andy D Hoffman, Manchester (GB); Alexander A Makarov, Manchester (GB)

(73) Assignee: GBC Scientific Equipment Pty Ltd., Dandenong (AU)

( * ) Notice: Subject to any disclaimer, the term of this patent is extended or adjusted under 35 U.S.C. 154(b) by 0 days.

(21) Appl. No.: 09/380,736

(22) PCT Filed: Mar. 12, 1998

(86) PCT No.: PCT/AU98/00164

§ 371 (c)(1),
(2), (4) Date: Sep. 13, 1999

(87) PCT Pub. No.: WO98/40907

PCT Pub. Date: Sep. 17, 1998

(30) Foreign Application Priority Data

Mar. 12, 1997 (AU) ..... PO5577

(51) Int. Cl.[7] ..... H01J 49/40
(52) U.S. Cl. ..... 250/287
(58) Field of Search ..... 250/287

(56) References Cited

U.S. PATENT DOCUMENTS

| | | | | |
|---|---|---|---|---|
| 3,898,456 A | 8/1975 | Dietz | | 250/299 |
| 4,423,324 A | 12/1983 | Stafford | | 250/281 |
| 4,490,806 A | 12/1984 | Enke et al. | | |
| 5,202,561 A | 4/1993 | Giessmann et al. | | 250/281 |
| 5,367,162 A | 11/1994 | Holland et al. | | |
| 5,376,788 A | 12/1994 | Standing et al. | | 250/287 |
| 5,689,111 A | 11/1997 | Dresch et al. | | 250/287 |
| 5,712,480 A | 1/1998 | Mason | | |
| 5,742,049 A | 4/1998 | Holle et al. | | 250/287 |

FOREIGN PATENT DOCUMENTS

| | | | | |
|---|---|---|---|---|
| GB | 2274197 | | 7/1994 | |
| GB | 2274197 A | * | 7/1994 | ..... H01J/49/40 |
| GB | 2305539 | | 4/1997 | |
| WO | 89/06044 | | 6/1989 | |

OTHER PUBLICATIONS

Holland, et al., "Design, construction, and evaluation of an integrating transient recorder for data acquisition in capillary gas chromatography/time–of–flight mass spectrometry", American Institute of Physics, Jan. 1991, pp. 69–76.

Derwent WPAT Abstract Accession No. 98–103161/10, EP 822574 A, Bergmann, EM, Feb. 4, 1998.

Derwent WPAT Abstract Accession No. 91–282645/39, DE 4107794 A, Hitachi, KK, Sep. 19, 1991.

* cited by examiner

*Primary Examiner*—Jack Berman
(74) *Attorney, Agent, or Firm*—Pillsbury Winthrop LLP

(57) ABSTRACT

A time of flight (TOF) analysis device such as a TOF spectrometer is disclosed which includes a torch and sample introduction system for supplying a beam of ions to an orthogonal accelerator. The orthogonal accelerator deflects ions in the beam sideways to an ion reflector and then to a detector. The spectrometer includes a time to digital conversion circuit and an integrated transient recorder. The detector can include a series of dynodes and the voltage between dynodes can be varied in order to maintain a constant voltage between an ion sensitive surface and the last of the dynodes. A second ion mirror may be used for reflecting some of the ions towards the detector. The orthogonal accelerator is configured and powered to provide spatial focussing according to a predetermined condition. The spectrometer may also include vertical focussing for focussing the beam back to a size commensurate with the size of the detector after the beam has been focussed by beam forming optics. The spectrometer is configured with three differentially pumped vacuum chambers.

12 Claims, 6 Drawing Sheets

TIME OF FLIGHT ANALYSIS DEVICE

This application is the national phase of international application PCT/AU98/00164 filed Mar. 12, 1998 which designated the U.S.

FIELD OF THE INVENTION

This invention relates to a time of flight analysis device and in particular to an inductively coupled plasma time of time of flight mass spectrometer. However, the invention has application to time of flight instruments in which a sample is produced by methods other than ICP techniques, such as MALDI techniques, electro spray or a APCI and elemental analysis by glow discharge or DC plasma means.

BACKGROUND OF THE INVENTION

Time of flight mass spectrometers analyses a sample by first vaporising and then ionising the sample using a number of possible techniques such as those described above. Once formed, the ionised components of a sample are directed towards an electrostatic accelerator usually by some form of ion optics which collimates or focuses the ion beam. The accelerator imparts a specific kinetic energy to all the ions having the same charge, producing a pulse of ions in which the individual ion velocities are inversely proportional to the square root of the mass to charge ratio. The ion pulse is then directed towards an ion detector a well defined distance away. In travelling to the detector the original ion pulse will be dispersed as a result of the different velocities of the different ion masses. The distribution of ionic masses in the initial pulse and hence the sample can then be determined by measuring the time each ion or group of ions takes to travel the known distance to the detector.

SUMMARY OF THE INVENTION

The object of the present invention is to improve existing time of flight analysis devices.

A first aspect of the invention may be said to reside in a time of flight analysis device, including:

means for producing an ionised sample for analysis;

a time of flight cavity;

means for receiving the ionised sample and for directing the ionised sample into the time of flight cavity;

a detector for detecting the ionised sample after travel through the time of flight cavity;

an analysis means coupled to the detector for receiving an output from the detector, said analysis means including;

(a) time to digital conversion circuit means for receiving the output; and (b) an integrating transient recorder circuit means coupled in parallel with the time to digital conversion circuit means, also for receiving the output from the detector.

By coupling both a time to digital conversion circuit and integrating transient recorder circuit to the detector the dynamic range of the device is greatly improved. The time to digital conversion circuit means can determine results for very small concentrations of sample in which very few ions of the desired species may be present in the ion flow, and the integrating transient recorder circuit means analysing much higher abundant species which may be present to thereby give the increased dynamic range of the device.

Time to Digital Conversion (TDC) uses a system of accurate timers to accurately record the actual arrival time of each pulse induced by arrival of individual ions at the detector. By summing many consecutive spectra a picture of the relative quantities and mass of the constituents is built up. While very fast and accurate, a key limitation of this approach derives from the fact that the system detects ion pulses as logical events (ie. ion present or ion not present). If then two or more ions arrive within one time bin, or if the pulse produced by the detector is induced by arrival of a short multi ion packet, count from only one event is recorded and the other ions are lost. State of the art multiple stop time analysers for TOF MS have now days excellent timing resolution (fractions of nS) and dynamic range, but still suffer from high dead time (>50 nS). The dynamic range of such a system depends only on the upper counting limit of the counters used, providing the threshold of the discriminator usually installed between analogue and digitising parts eliminates all the analogue noise sources (like preamplifier noise etc.) At a rate of 10–50 kHz (typical repetition frequency of single scan in TOF MS), having <0.5 ions per peak per scan, the dynamic range of 1 e6, achievable in quadruple ICPMS within 1 min of acquisition, would require 7–33 min of acquisition, making "TDC only" technique not very practical. In the Integrating Transient Recorder (ITR) a transient signal of a single waveform from a repetitive bunch is digitised by a very high speed ADC (typically at less than 5 ns sampling rate), and then data representing the magnitude of signal waveform at each sampling point is temporarily stored in some buffer memory for further summation with the set of data representing the next waveform. After predetermined number of summations integrated data are outputed in the form of magnitude-time array. ITR based techniques always employ some data reduction via summation before storage, as real time spectra acquired at very high repetition frequency of 10–50 kHz can not be stored individually on line. Moreover, ion detectors usually have very high standard deviations on the gain resulting in single ion pulse height distribution with up to 100% RSDs, so ITR can not be used for quantitative analysis when less than a 100 integrated ion pulses represent mass peak. As a result of that and due to limited noise figures of analog signal processing means, the dynamic range of the technique is limited to about 1e4 value. Thus incorporating both a multistop TDC and a Integrating Transient Recorder in parallel, allowing acquisition and processing of TOF mass spectra where any mass peak can contain 1e-5 to 1e3 ions, said limits are given as an example only are defined by ion extraction pulse repetition frequency (100 kHz) and linearity range of ion detector.

Preferably the analysis means also includes a logarithmic preamplifier for extending the dynamic range of the integrating transient recorder circuit means and pulse stretching after a discriminator to increase the effectiveness of the time to digital conversion circuit means.

The second aspect of the invention relates to protection and extension of the lifetime of detectors used in time of flight analysis devices. Modern ion detectors suffer from low dynamic range, being unable to withstand high input currents which may destroy the detector or significantly reduce its lifetime. Discrete dynode electro multipliers have been demonstrated to have higher range of acceptable incoming ion current at which the gain is not declining, in comparison to continuous dynode detectors. However, at extremely high count rates even discrete dynode detectors age quickly. This results in two problems. The overall lifetime of detectors becomes unpractically short and maintenance of a constant gain as the detector wears out requires a change in the voltage applied across the dynodes. The change in voltage is conventionally done by either changing detector entrance DC potential with the anode kept at virtual ground or by applying a DC potential to the anode, which is capacitively decoupled with a preamplifier or the last dynode. Changing the ion detector entrance potentials in time of flight mass spectrometers necessarily implies changing liner voltage. This means the average ion energy changes which means the mass scale has to be recalibrated for every value of detector voltage. Supplying DC potentials to the anode or the last dynode means capacitively coupling DC high voltage supply to the input of a preamplifier so that the AC ripple of the supply affects noise of the detection system.

A second aspect of the invention may be said to reside in a detector for a time of flight mass spectrometer, including:

an ion sensitive surface for receiving a flow of ions;

a plurality of discrete dynodes arranged in series for receiving a secondary emission from the ion sensitive surface when ions impact on the ion sensitive surface, the secondary emission being amplified by the discrete dynodes; and means for varying the voltage between the ion sensitive surface and an adjacent dynode or between any pair of adjacent dynodes in this series of discrete dynodes so that a voltage between the ion sensitive surface and a last of the dynodes in this series of dynodes can be maintained, substantially.constant and the gain of the detector is varied by varying the voltage between the ion sensitive surface and the adjacent dynode or between said any pair of adjacent dynodes by, the means for varying the voltage.

Thus, as the detector wears through the lifetime of the detector it is not necessary to alter the voltage across the detector and the voltage can be kept at a constant voltage, such as a maximum constant voltage, thereby eliminating the need to recalibrate the mass scale which would otherwise be necessary should the voltage have been changed. In order to change the gain as the detector wears the means for varying the voltage need only be adjusted to change the voltage between the ion sensitive surface and the adjacent dynode or between the pair of adjacent dynodes in the series.

This aspect of the invention may also be said to reside in a detector for a time of flight analysis device, including:

an ion sensitive surface for receiving an ion flow and for producing a secondary emission;

a plurality of discrete dynodes arranged in series with respect to one another for receiving and amplifying the secondary emission; and means for preventing at least a part of the secondary emission or amplified secondary emission from reaching any one of the dynodes.

Thus, according to this aspect of the invention the detector can be protected from high ion currents which are produced when a high concentration of a particular ion species is present in the sample to be analysed and which otherwise would produce significant wear of the detector should that species be detected by the ion sensitive surface and amplified by the series of dynodes. By preventing the secondary emission resulting from that species from reaching any one of the dynodes the dynodes down stream of that dynode can be protected from the increased secondary emission current which would otherwise be produced to thereby increase the lifetime of the detector.

Preferably the secondary emission or amplified secondary emission is prevented from reaching any particular one of the dynodes by temporarily maintaining that dynode, or a control electrode in the vicinity of the dynode, at a potential different from its normal operating potential thereby deflecting the secondary emission or amplified secondary emission from its normal path.

Preferably a quenching electrode is provided for receiving the secondary emission after the deflection from its normal path so that the secondary emission is effectively removed from the sensitive region of the detector before the various dynodes and electron potentials are restored to the normal operating values.

A third aspect of the invention is related to the push out of packets of ions into the time of flight cavity of an analysis device. Time of flight mass spectrometers which include a means for producing an ion source such as by ICP (inductively coupled plasma) and which include an orthogonal accelerator to move packets of ions transverse to their original direction of travel into a time of flight cavity are known. The time at which the orthogonal accelerator is biased to push the ions in the transverse direction into the time of flight cavity is used as a timing thresholding for the time of travel of the ions from the orthogonal accelerator to the detector to provide the time measurement for the ion travel. Orthogonal acceleration time of flight mass spectrometry has the distinction of a higher duty cycle ideally reaching 50% or higher values.

Another known advantage of TOF MS over other techniques is known to be "simultaneousness" of the technique, meaning that all the ions created at a particular time moment in the ion source are then separated according to their mass to charge ratio within the TOF analyser and form mass peaks of the same mass spectrum. That is, each individual single ion extraction spectrum contains ions created at the same time in the ion source, so that not only processes happening within the ion source may be observed (with typical sampling frequency of up to 100 kHz), noise of the ion source may be almost completely eliminated, giving better precision and better accuracy of isotope ratio measurements. However this is true only if ions created simultaneously in the ion source are translated into the extraction region (ie the orthogonal accelerator) of TOF instrument simultaneously to be sampled by the same extraction pulse. Unfortunately, this is not (and never) the case, as ions are extracted from the source usually by means of an electrostatic field, accelerating ions to a certain predetermined energy. As a result, ions of different masses created simultaneously in the ion source, accelerate to different velocities (depending on square root of mass), and arrive at the orthogonal extraction region at sufficiently different time, so that some ions from the group of ions created simultaneously miss the extraction pulse completely, some ions are extracted, and some ions are extracted by the next oncoming extraction pulse together with the ions created within the ion source at a later time.

The third aspect of the invention may be said to reside in a time of flight analysis device, including:

means for producing a ion beam and for directing the ion beam in a first direction, a first orthogonal accelerator for directing some of the ions in the ion beam transverse to the first direction into a time of flight cavity;

a second orthogonal accelerator;

an ion mirror for reflecting ions in the beam which pass through the first orthogonal accelerator and the second orthogonal accelerator back in to the second orthogonal accelerator, so the second orthogonal accelerator can push the reflected ions transverse to the first direction into the time of flight cavity; and a detector for detecting the ions after the ions pass along the time of flight cavity.

According to this aspect of the invention heavy ions such as uranium ions are pushed sideways by the first orthogonal accelerator and lighter ions such as lithium ions which are produced at the same time and at the same temporal position as the uranium ions pass through the first orthogonal accelerator, the second orthogonal accelerator and are reflected by the ion mirror back into the second orthogonal accelerator where they are pushed sideways into the cavity at the same time as the uranium atoms by biasing the first and second orthogonal accelerators at the same time. By reflecting the lighter ions back into the orthogonal accelerator the direction of travel of the lighter ions is such that the two orthogonal accelerators can be arranged symmetrically with respect to the detector so that the path of travel of ions pushed out by both orthogonal accelerators will be identical. Thus, ions produced at the same position at the same time can be pushed out at the time of flight cavity at the same time for detection. Thus, the lighter ions are effectively extracted from a longer section of the beam travelling in the first direction than the heavier ions so that the duty cycle for the lighter ions is improved and becomes comparable to the duty cycle for the heavier ions.

Preferably the first and second orthogonal accelerators are separate from one another and accelerating and focussing means is provided between the first and second orthogonal accelerators. The energy to which the ions are accelerated between the first and second orthogonal accelerators and the dimension of the space between the first and second orthogonal accelerators may, however, be arranged in such a way that light ions which are let through during the extraction cycle of the first orthogonal accelerator (that is when the heavier uranium ions are pushed sideways) enter the second orthogonal accelerator leave it and returning back to the second orthogonal accelerator during the fill time (that is the time at which ions are travelling into the first orthogonal accelerator after the first extraction) of the next extraction cycle. These lighter ions are then pushed out by the second orthogonal accelerator by a push out pulse or bias supplied to both orthogonal accelerators simultaneously.

A further aspect of this invention may also be said to reside in a time of flight analysis device, including:

means for producing an ion beam;

a time of flight cavity;

orthogonal accelerator means for receiving the ion beam and for deflecting the ion beam sideways into the time of flight cavity;

an ion mirror at one end of the time of flight cavity for receiving the deflected ion beam and reflecting the deflected ion beam;

a detector for receiving the reflected ions; and a second ion mirror arranged transversed with respect to the first ion mirror for reflecting at least some of the reflected ions from the first mirror to the detector.

This aspect of the invention enables a relatively long orthogonal accelerator to be used so that lighter ions which are extracted from the longer section of the orthogonal accelerator undergo a second reflection by the second ion mirror so they are detected by the detector and do not miss the detector. Thus, once again lighter ions which are extracted from the longer section of the beam can be detected with the heavier atoms thereby increasing the duty cycle of the device.

Preferably the second ion mirror extends from the said one end of the time of flight cavity to the detector which is arranged at a first end of the flight cavity adjacent the orthogonal accelerator.

A further aspect of this aspect of the invention relates to duty cycle enhancement of orthogonal acceleration.

In an idealistic situation, when ion energy in the direction along the beam has no spread, all the ions with the same longitudinal energy reach the same point on the target (detector) after travelling through the time of flight analyser, as the trajectories of ions in electrostatic ion optics are energy dependant and mass independent. Usually, during adiabatic expansion through the orifice of the sampler cone of the analyser, ions of all masses pick up same average velocity (that of the bath gas). As a result the average energy is mass dependant and average final coordinate of the ions population when they rich the detector is mass dependent.

In real life, however, ion velocities and energies are defined by a variety of the processes occurring in the ion source and in the interface chamber during the expansion. One of the mechanisms defining ion energy is, for example, capacitive coupling of RF voltage to plasma. The RF potential is distributed long the plasma jet within interface and ions are extracted from the jet from the points (in time and space) which have different electrical potential. As a result, energy of ions is not sharply defined by velocity of the bath gas only, but by the properties of RF plasma coil and RF matching network.

This aspect of the invention may also be said to reside in a time of flight analysis device, including:

means for producing an ionised sample from which a beam of ions is generated;

an orthogonal accelerator for receiving the beam of ions and for deflecting the ion beam sideways;

a detector for detecting the ion beam deflected sideways by the orthogonal accelerator;

the orthogonal accelerator being longer in the direction of the ion beam than the length of the detector such that low energy and low mass ions reflected sideways from the ion beam from one position along the length of the orthogonal accelerator can arrive at said detector and high energy and high mass ions produced at a different position along the length of the orthogonal accelerator and pushed sideways are also received by said detector.

Thus, this aspect of the invention enables a conventionally sized detector to be used and to enhance the duty cycle of the orthogonal accelerator by simply increasing the size of the orthogonal accelerator.

In one preferred embodiment, the length of the orthogonal accelerator may-be approximately 50 mm and the length of the detector approximately 30 mm.

Preferably the length of the orthogonal accelerator is in the order of 1.5 to 3 times the length of the detector and most preferably approximately 2 to 3 times the length of the detector.

A fourth aspect of this invention relates to time of flight mass spectrometers, particularly to the method of time-spatial focussing in time of flight mass spectrometers.

In orthogonal accelerators (or any other beam chopper) ions are initially distributed within a finite beam width. When an acceleration (push-out) pulse is applied, ions appear at different points of created homogenous electric field (formed by a push-out plate and grid). As a result, they are accelerated to different energies. For example, if the distance between the plate and grid is 10 mm, and a push-out voltage applied is 1000 V, then the potential difference between two points separated by 1 mm would be 100 V. If beam width is 5 mm, then ions from outer edges of the beam would be accelerated to energies different by up to 500 eV. The ions closer to the plate, say, would acquire about 1000 eV. The ions 5 mm away from the plate would acquire 500 eV only. After leaving the orthogonal accelerator as a result, the ions of the same mass would have sufficiently different velocities, and would arrive at a detector at sufficiently different times. This implements increase in mass peak temporal width and hence decreases resolution.

Accordingly, a fourth aspect of the invention may be said to reside in a time of flight analysis device, including:

means for producing an ionised sample from which a beam of ions is generated;

an orthogonal accelerator for deflecting the ion beam sideways, the orthogonal accelerator being configured and powered so that ions of the same charge to mass ratio which are moved sideways from the beam of ions and commence sideways movement from different distances within the beam in the direction of sideway movement are time and spatially focused at a focus position, the spatial focussing being performed according to the following conditions for finite spatial spread $$\int_{s_0-w/2}^{s_0+w/2}\sum_{n=1}^{\infty}\left|\frac{1}{n!}\frac{d^nT}{ds^n}(\delta s)^n\right|ds=0, \tag{5}$$

$S_0$ is coordinate of the ion beam

W is the full width of the ion beam; and a detector for detecting the beam which is deflected sideways by the orthogonal accelerator.

Since ions which are produced at different positions are focused to the same time and spatial focus the resolution of the analysis device is increased.

Preferably the detector is located at the focus position or the focus serves as a virtual ion source for another time of flight analyser, for example mass reflectron.

The orthogonal accelerator is preferably a two or three plate accelerator.

Preferably for three plate and therefore three stage focussing the spatial focussing is performed according to the following conditions $$D=2\cdot\{((s_0+\Delta s)^{1/2}-(s_0-\Delta s)^{1/2})\cdot E_s^{-1/2}+E_d^{-1}\cdot(B_+^{1/2}-C_+^{1/2}-B_-^{1/2}+C_-^{1/2})+E_e^{-1}\cdot(A_+^{1/2}-B_+^{1/2}-A_-^{1/2}+B_-^{1/2})\}\cdot(A_-^{-1/2}-A_+^{-1/2})^{-1}, \tag{7}$$

where $A=sE_s+dE_d+eE_e$; $B=sE_s+dE_d$; $C=sE_s$;

indexes −, + mean that value of correspondent parameter A, B or C is considered at $S=S_0-W/2$, $S=S_0+W/2$ respectively, D is distance to spatial focus from exit of orthogonal accelerator e is gap width of third gap of the 3-step acceleration d is gap width of second gap of the three-step acceleration Es, Ed and Ee are the field strengths of the first, second and third stages of the three stage acceleration respectively.

A further problem which occurs with conventional time of flight mass spectrometers is due to significant Coulomb forces which exist at focal points of the ion beam as the ion beam travels from the ion source to the detector. Most time of flight mass analysis employ ion beams at relatively low intensity (less than 1nA). Typical ion currents detected in ICP mass spectrometers are of the order of 10 to 50 nA, with ion energy of the order of 10 eV.

This means very severe space charge effects are happening in low voltage parts of the ion optics especially at the focal points where ions experience significant coolant forces.

The object of a fifth aspect of the present invention is concerned with overcoming space charge-effects, effecting resolution and sensitivity of time of flight analysis devices where ion beams are focussed to a small point so that a large number of ions may be present in a very small area of space where space charge effects may effect the resolution and sensitivity of the instrument.

This aspect of the invention may be said to reside in a time of flight analysis device, including:

means for producing an ionised sample from which a beam of ions is generated;

an orthogonal accelerator for deflecting the ion beam sideways;

beam forming optics between the means for producing the ionised sample and the orthogonal accelerator for focussing the beam of ions so that at every focus plane the beam is focussed such that one dimension of the beam is larger than another dimension of the beam;

a detector for detecting the ion beam deflected sideways by the orthogonal accelerator; and vertical focussing means between the orthogonal accelerator and the detector for focussing the beam back to a size commensurate with the size of the detector.

Preferably the beam forming optics focus the beams at every focus plane between the means for producing the ionised sample and the orthogonal accelerator, the beam has a dimension of about 30 mm by 3 mm.

Preferably the vertical focussing means is located at a position where ions of different masses are separated in time so that space charge effects are less severe when the beam crossover becomes smaller after vertical focussing.

This aspect of the invention may also be said to reside in a time of flight analysis device, including:

means for producing an ionised sample from which a beams of ions is generated;

an orthogonal accelerator for deflecting the ion beam sideways for producing ion packets, the ions in each packet separating as the ions in each packet move sideways due to different mass charge ratios of the ions in each packet; and vertical focusing means located at a position where the ions in the ion packet have separated in time, for vertically focusing the ions which have been separated so as to avoid excessive space charge effects.

A sixth aspect of the invention concerns pump size for producing vacuums within the time of flight analysis device.

This aspect of the invention may be said to reside in a time of flight analysis device, including:.

an interface chamber for receiving an ion beam;

a main pump for evacuating the interface chamber;

an intermediate chamber for receiving the ion beam from the interface chamber;

a first low pressure pump for evacuating the immediate vacuum chamber, the first pump being coupled to the main pump;

a main vacuum chamber for forming a time of flight cavity and for receiving ions for time of flight travel to a detector;

a second low pressure pump for evacuating the main vacuum chamber;

an additional chamber between the intermediate chamber and the main vacuum chamber;

a third low pressure pump for evacuating the additional chamber, the third low pressure pump being coupled to the main pump; and the second low pressure pump being coupled to the third low pressure pump.

By the inclusion of the additional vacuum chamber and the third low pressure pump the pump size of the low pressure pumps and main pump can be reduced and although an additional pump is required. Pump costs are reduced in view of the ability to reduce the size of the pumps.

Preferably a petition wall is arranged between the main vacuum chamber and the additional vacuum chamber.

BRIEF DESCRIPTION OF THE DRAWINGS

Preferred embodiments of the invention will be described, by way of example, with reference to the accompanying drawings in which.

DESCRIPTION OF THE PREFERRED EMBODIMENTS

Figure 1:
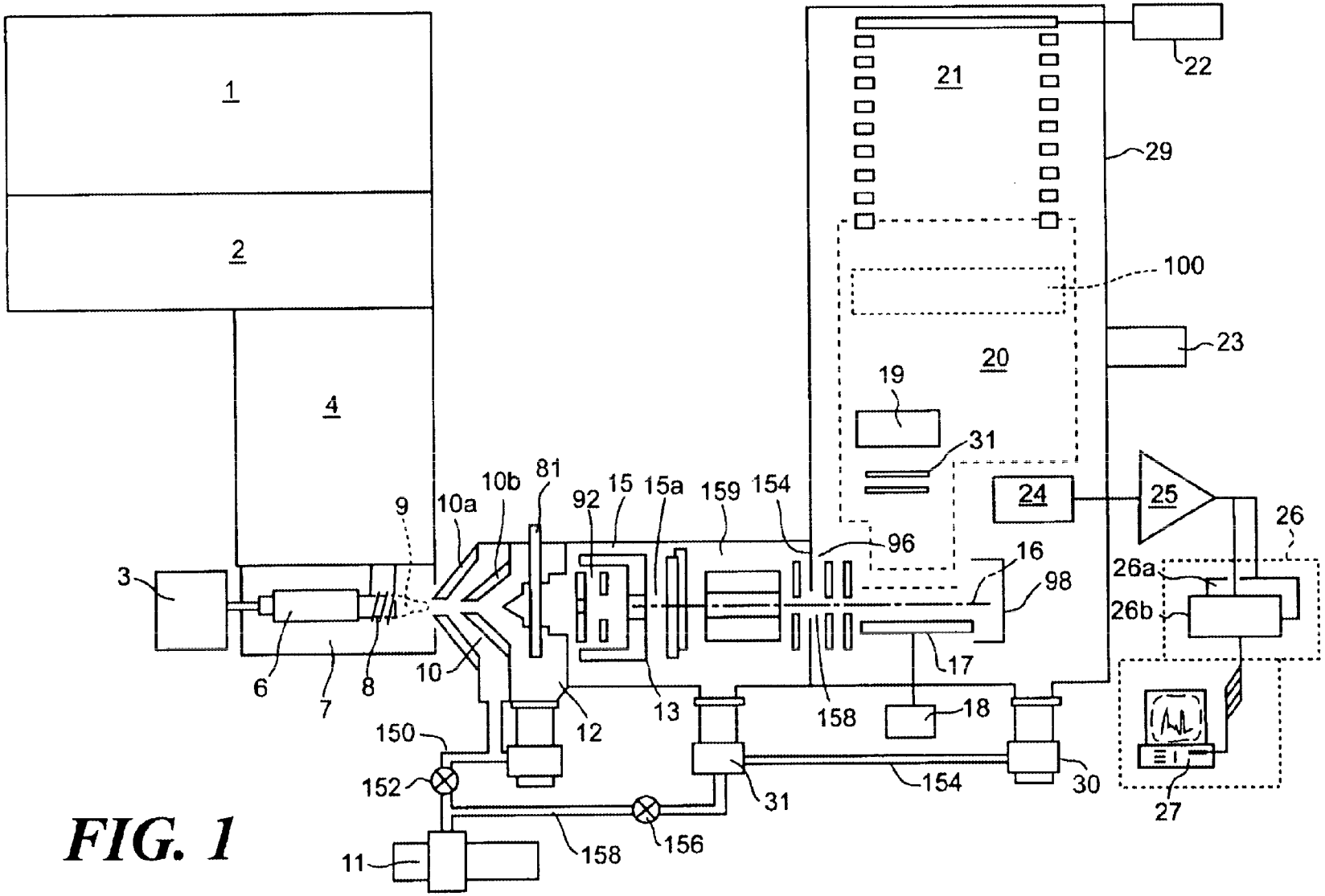
FIG. 1 is a schematic view of a ICP time of flight mass spectrometer according to the preferred embodiment of the invention.

FIG. 1 shows the general layout of a time of flight mass spectrometer using inductively coupled plasma as an ion source. The mass spectrometer of FIG. 1 includes a radio frequency generator 1 for supplying radio frequency power via a matching network 4 to an inductance coil 8, and a gas control unit 2 for supplying bath gas such as argon or helium to an ICP torch 6 and a sample introduction system 3. The sample introduction system 3 supplies gas flow with particles of a sample dispersed in it for injection into plasma. The ICP torch 6 and the inductance coil 8, located within a torch compartment 7, produce plasma consisting of species of bath gas and sample material which is to be analysed which plasma is schematically shown by reference numeral 9. Plasma is sampled through orifice of a sampler cone 10*a* into an interface chamber 10 which is evacuated by a rotary pump 11 and then further into an intermediate vacuum chamber 12 through an orifice in a skimmer cone 10*b*. The intermediate chamber 12 is pumped by a turbo-molecular pump 14. A beam forming optics 13 is provided within a side vacuum chamber 15 behind third orifice 15*a* along the path of the sampled plasma jet for creating a beam of ions of bath gas and ions of species representing the sample. Reference number 5 represents a beam forming optics power supply, and reference number 16 represents said ion beam which is to be analysed by means of a time of flight analyser located further downstream within a main vacuum chamber 29 which includes a time of flight chamber. A turbo-molecular pump 30 provided for pumping the main chamber down to acceptable pressure for analysis pressure.

An orthogonal accelerator 17 is provided for pushing out a multi-mass ion packet from the beam 16. A push out pulse supply 18 is coupled to the accelerator 17 for providing repetitive push-out voltage at typical frequency of 40 kHz. The dropped out ions or ion packets which are moved out of the beam 16 travel within the field free space of liner 20 towards ion gate 19, being partially separated in time into iso-mass ion packets shown schematically by reference number 31. The ion gate 19 is described in our provisional application no. PO 4810 the contents of which is incorporated by this reference. The potential of liner 20 is supplied to it by a liner power supply 23. An ion mirror 21 provided at the end of the liner 20, and an ion mirror power supply 22 is provided. The ions passing through the gate 19 travel down the field free space of the liner 20 and are turned about by the ion mirror 21 to travel back towards a detector 24. The detector 24 detects the ions and is coupled to an amplifier 25 which in turn is coupled to a detection system 26 which in turn can be coupled to a computer 27 for analysing and displaying results.

According to a first embodiment of the invention the amplifier 25 is a logarithmic amplifier and is coupled in parallel to a time to digital converter 26*a* and a integrating transient recorder 26*b* which are included in the data collection and analysing circuitry generally identified as a detection system 26. The inclusion of the circuits 26*a* and 26*b* in parallel with one another increases the dynamic range of the spectrometer because the time to digital conversion circuitry 26*a* can collect data and analyse that data in respect of very small ion concentrations and the integrating transient recorder circuitry 26*b* can collect and analyses data of much higher concentration species which may be present in the ion sample beam. The integrated transient recorder 26*b* can acquire spectra for Nth ion extraction pulse where the time to digital conversion circuitry 26*a* requires spectra for all ion extraction pulses. Number N is set according to the need for precision of measurements and typically is high enough to compensate for high deviation in single ion pulse height typically N=40–100, making minimal number of single ion pulses per peak of about 2000 in 3 seconds. That means that actual data reduction may be done at a slower rate i.e. summation is not needed to be done at the rate of 100 kHz. Blanking of the most abundant peaks in the obtained spectrum may also occur. For known average single ion pulse heights the overflow level of the ITR circuitry 26*b* is set in such a manner that when an integrated signal in a certain time bin (mass channel) reaches its limit, the ions corresponding to the mass channel are eliminated out of the beam by the ion gate 19. The number of shots needed for reaching the limit is a measure of peak intensity. This is done in order to extend the life of the detector as well as for increasing abundance sensitive of the instrument. Pulse stretching after the discriminator have included to increase the effectiveness of the TDC circuitry 26*a*.

Figure 2:
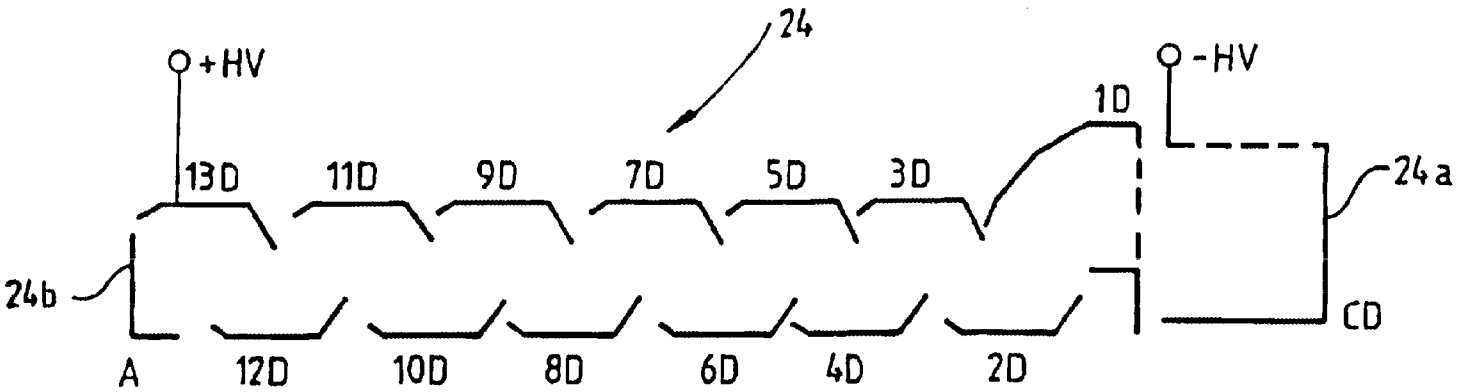
FIG. 2 is a diagram showing a typical discrete dynode type detector used in time of flight mass spectrometers.

FIG. 2 shows a schematic layout of a typical detector 24 used in time of flight mass spectrometry. The detector 24 has a conversion dynode 24*a* having an ion sensitive surface and a plurality of discrete dynodes numbered 1D to 13D in FIG. 2. A collection anode 24*b* is arranged after dynode 13D as is well known. As is also well known when ions impact on the ion surface of the conversion dynode 24*a* a secondary emission of electrons or photons is produced which passes to the first dynode numbered 1D in FIG. 13. The secondary emission is effectively amplified by the 13 dynodes and the amplified secondary emission impinges on the collection anode 24*b* to produce an output signal. Typically, an initial low voltage is supplied between the conversion dynode 24*a* and the 13th dynode such as a voltage of 2 KV in order to set the gain of the detector. As the detector wears during use of the spectrometer it is necessary to increase the voltage applied to compensate for the wear of the detector and to maintain the gain constant. The increase in the voltage interferes with the electrostatic configuration of the spectrometer requiring a recalibration of the mass scale of the spectrometer to compensate for the different electrostatic charge or condition of the spectrometer which will cause ions to travel more quickly or slowly in the time of flight cavity generally defined by the liner of 20.

Figure 3:
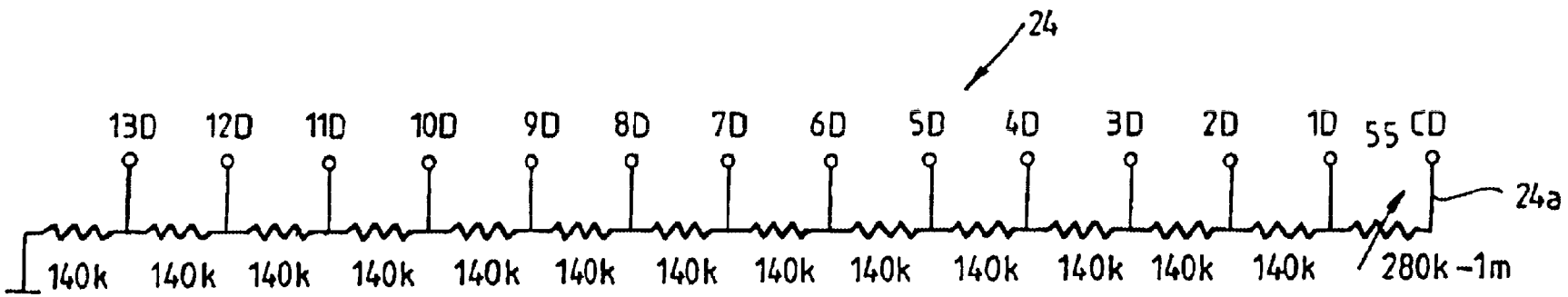
FIG. 3 is the schematic diagram of a detector according to one embodiment of the present invention.

The detector of the preferred embodiment of the present invention is shown in FIG. 3 and overcomes the problems with the conventional detectors 24 described above. As is shown in FIG. 3 the detector includes 13 discrete dynodes as in the detector of FIG. 2, a collection anode (not shown) and a conversion dynode 24*a*. According to this embodiment a variable resistor 55 is located between any pair of adjacent dynodes such as between the collection dynode 24*a* and the first dynode numbered 1 in FIG. 3. According to this embodiment of the invention a high voltage (typically the highest voltage required in order to operate the detector 24 after the detector has worn to its maximum degree) is applied between the conversion dynode 24*a* and the 13th discrete dynode and is maintained constant throughout the life of the detector 24. The gain of the detector 24 is set by varying the variable resistance 55 and to maintain the gain constant as the detector 24 wears the variable resistance is simply altered thereby maintain the gain constant. Thus, the electrostatic condition of the spectrometer is not altered because there is no need to vary the voltage between the conversion dynode 24*a* and the 13th dynode and therefore recalibration of the mass scale is not required.

Furthermore, secondary electron pulses may be prevented from reaching any one of the dynodes by temporarily maintaining that dynode or a control electrode (not shown) in the vicinity of that dynode at a potential different from its normal operating potential thereby deflecting the secondary electron pulse from its normal path. Thus, the variable resistor 55 may be used to not only set the gain of the detector but also to temporarily deflect the secondary electron pulse so that the electron pulse does not reach the first dynode and is therefore not amplified by the dynodes thereby saving the dynodes and increasing the life of the detector 24. The resistor 55 may be altered when unwanted ions arrive at the collection dynode 24*a* such as the ions relating to the matrix species which is used to entrain the sample species in the ion source for ionization i.e. argon ions, so the secondary emission relating to argon ions are not amplified by the dynodes 1D to 13D and therefore the dynodes do not wear due to the increased electron impingement upon their surfaces. Although in FIG. 3 the variable resistor 55 is shown between the conversion dynode and the dynode numbered 1D in the discrete series of dynodes, the variable resistor or additional variable resistors could be provided between any pair or all pairs of the dynodes. As shown in FIG. 3 the value of the variable resistance 55 is preferably between 280 k ohms and 1 mega ohm. Also, by variable resistor any arrangement which alters the electrical potential of one dynode with respect to an adjacent dynode or anode is meant ie dynamic load.

Figures 4, 4A, 4B, 4C:
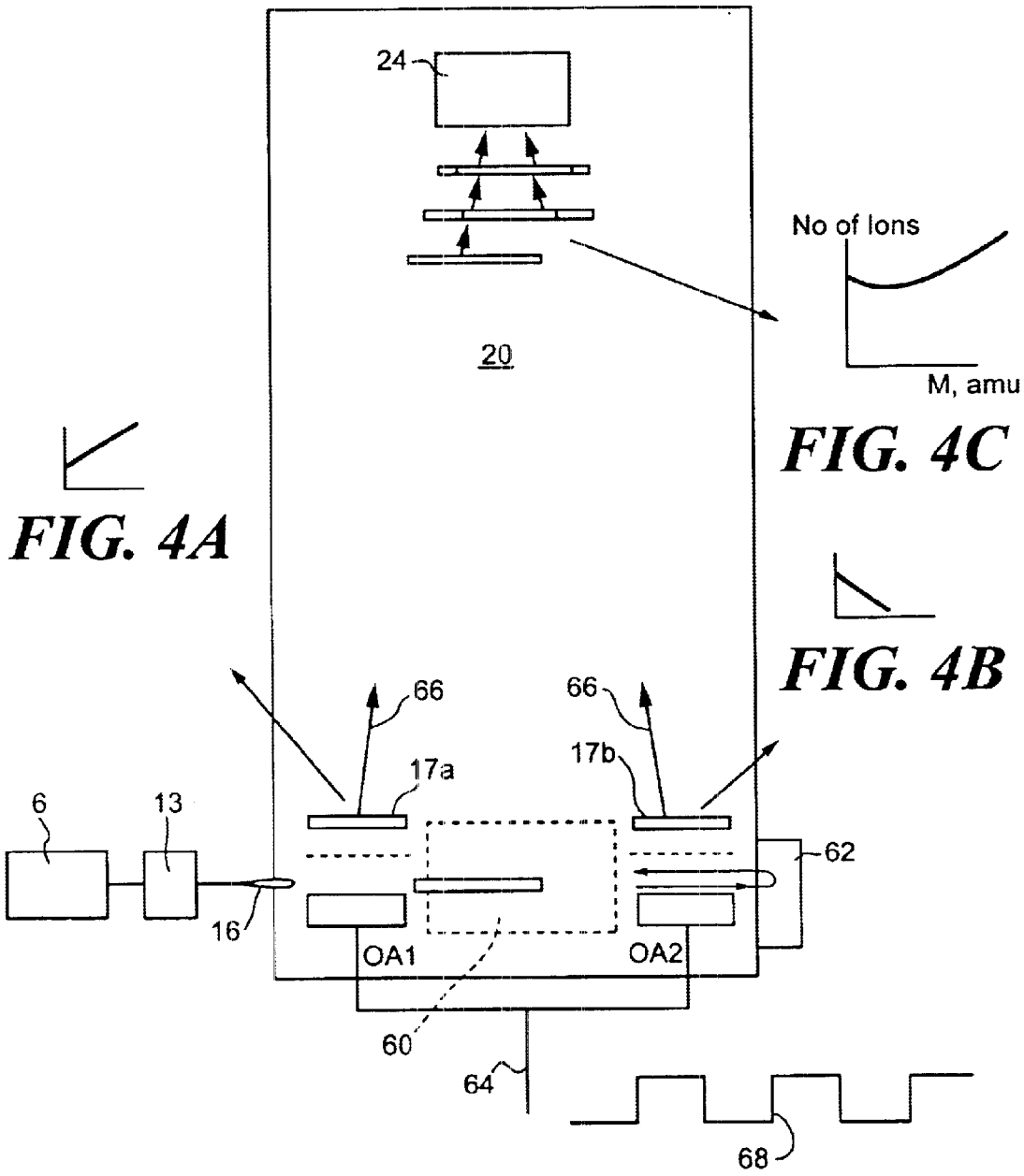
FIG. 4 is a diagram of an orthogonal accelerator arrangement according to one embodiment of the invention which may be used in the spectrometer of FIG. 1.

FIG. 4 shows one preferred form of an orthogonal accelerator arrangement. The ion source 6 and beam optics 13 are schematically shown and produce ion beam 16. A first orthogonal accelerator 17*a* is shown at one end of a time of flight cavity generally defined by liner 20. A detector 24 is arranged at the other end of the liner 20. However, in other embodiments as is shown in FIG. 1 an ion reflector could be arranged at the end of the liner 20 and the detector arranged adjacent the orthogonal accelerator 17*a*.

A second orthogonal accelerator 17*b* is arranged beside the accelerator 17*a* and spaced from the accelerator 17*a* in the direction of travel of the beam 16. An accelerating and focussing device 60 is arranged between the accelerator 17*a* and 17*b*. An ion mirror 62 is arranged on the far side of the second accelerator 17*b* with respect to the ion source 6 and optics 13 which produced the beam 16.

Both accelerators 17*a* and 17*b* are coupled to a common powering circuit schematically represented by reference 64 to which pulses schematically represented by reference 68 can be applied to push out ions from the beam 16 so that the pushed out ions travel in the direction of arrows 66 through the liner 20 to detector 24.

Heavy ions such as uranium ions produced in the ion source 6 and lighter ions such as lithium ions which are produced at the same time and at the same temporal position in the ion source 6 travel at different speeds in the beam 16 towards the accelerator 17*a* and 17*b* because of the different mass of those ions. By the time heavier uranium ions emanating from the same position as lithium ions arrive or fill the accelerator 17*a* the lighter lithium ions have passed through the accelerator 17*a* and also through the accelerator 17*b* to be returned back by the ion mirror 62 to again pass into the accelerator 17*b*. The space between the accelerator 17*a* and 17*b* together with the accelerating and focussing means is selected such that lithium ions are turned about by the ion mirror 62 and again fill the accelerator 17*b* at the same time as the heavier uranium ions are filling the accelerator 17*a*. Pulse 68 which is.applied to circuit 64 produces a push out voltage on the accelerators 17*a* and 17*b* which simultaneously push the ions filling the accelerator 17*a* and 17*b* out side ways in the direction of the arrows 66 so that the uranium ions and lithium ions currently commence travel towards the detector 24.

As can be seen from FIG. 4 the accelerator 17*a* and 17*b* are arranged symmetrically with respect to the detector 24 and the direction of travel of the ions in the accelerator 17*a* causes the ions to move at an angle with respect to the longitudinal axis of the line 20 towards the detector 24 as shown by the left hand arrow 66. The lighter lithium ions which have been turned about by the ion mirror 62 and which are travelling in the opposite direction to the ions in the accelerator 17*a* are pushed out by the accelerator 17*b* so they travel in a direction of the right hand arrow 66 in FIG. 4. It will be noted that the arrows 66 are indicative of ion flow paths which are of identical distance from the respective accelerator 17*a* and 17*b* to the detector 24 so that the distance of travel of the ions is identical regardless of which accelerator pushes the ions out from the beams 16. Thus, time of flight from the accelerator 17*a* and 17*b* and arrival of the ions at the detector 24 will produce a mass spectra of the sample ions in the beam 16. With this embodiment of the invention ions produced at the same time and from the same temporal position in the ion source 6 will be pushed out from the beam 16 with effectively the same extraction pulse being applied to the accelerator 17*a* and 17*b* regardless of the different speed travel of the light and heavy ions in the beam 16. Thus, ions created at the same time can be detected in one extraction pulse which enables the processes happening within the ion source to be traced so that any unusual phenomena happening at the time of creation of various ions will effectively cancel out because the same phenomena will effect all the ions of interest. Those ions will be produced by a single extraction pulse applied to the accelerator 17*a* and 17*b*. Instead of the same extraction pulse extracting the ions from the accelerator 17*a* and 17*b*, a first extraction pulse could be used to extract the heavier ions filling the accelerator 17*a* and a subsequent pulse could be used to extract the lighter ions from the accelerator 17*b* so that ions produced from the same temporal position could emanate from the accelerators 17*a* and 17*b* in subsequent extraction pulses applied to the accelerator 17*a* and 17*b*. Further still, ions produced from different temporal positions can also be extracted in the same extraction pulse applied to the accelerator 17*a* and 17*b* so phenomena occurring at different temporal positions can be monitored with respect to one another in the detected ions arriving at the detector 24.

In the arrangements discussed above the extractional length of the orthogonal accelerator 17 is effectively increased by providing two accelerators 17*a* and 17*b* so that heavier and lighter ions can be extracted from the accelerator at the one time thereby decreasing the time required to produce a full mass spectra of the sample lines produced in the ion source 6.

Figure 5:
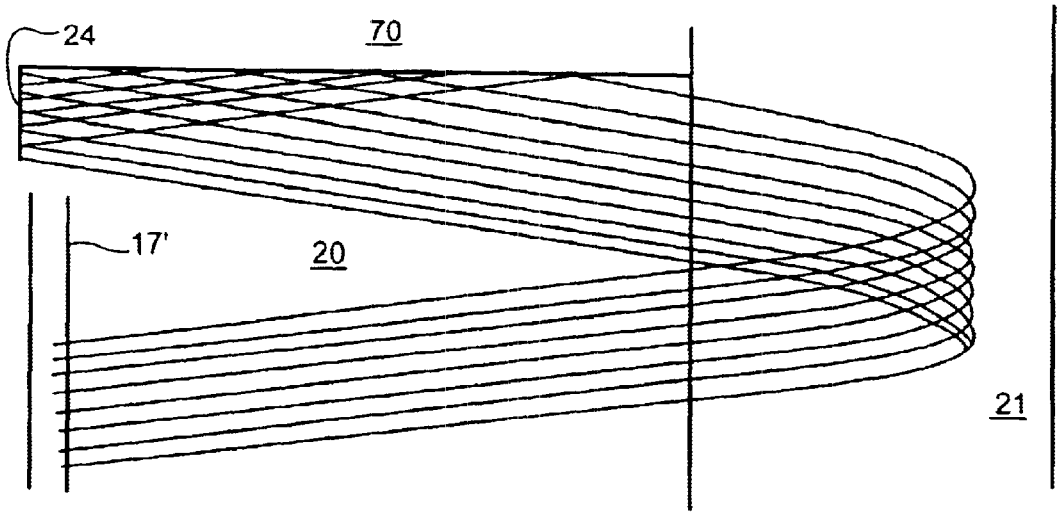
FIG. 5 is a view of an orthogonal accelerator and ion mirror arrangement according to another embodiment of the invention which may be used in the embodiment of FIG. 1.

FIG. 5 shows a further embodiment of the invention in which a single relatively long orthogonal accelerator 17' is utilised. The accelerator pushes ions out of the beam 16 (not shown) towards ion mirror 21 and the ion mirror reflects the beam of ions towards a detector 24 arranged adjacent the orthogonal accelerator 17'. Because the accelerator is long the ions pushed out of the beam 16 are spread over a substantial distance so they spread a distance greater than the size of the detector 24. In order to focus the beam of ions pushed out by the accelerator 17' a second ion mirror 70 is arranged which is perpendicular to the mirror 21 and which runs down the side of the liner at 20 from a position substantially adjacent the detector 24 and orthogonal accelerator 17' to the mirror 21. The ion mirror 70 refocusses the beam to reduce its spread to a size which coincides with the detector 24 so that all of the ions pushed out of the orthogonal accelerator 17' are received by the detector 24.

Figure 6:
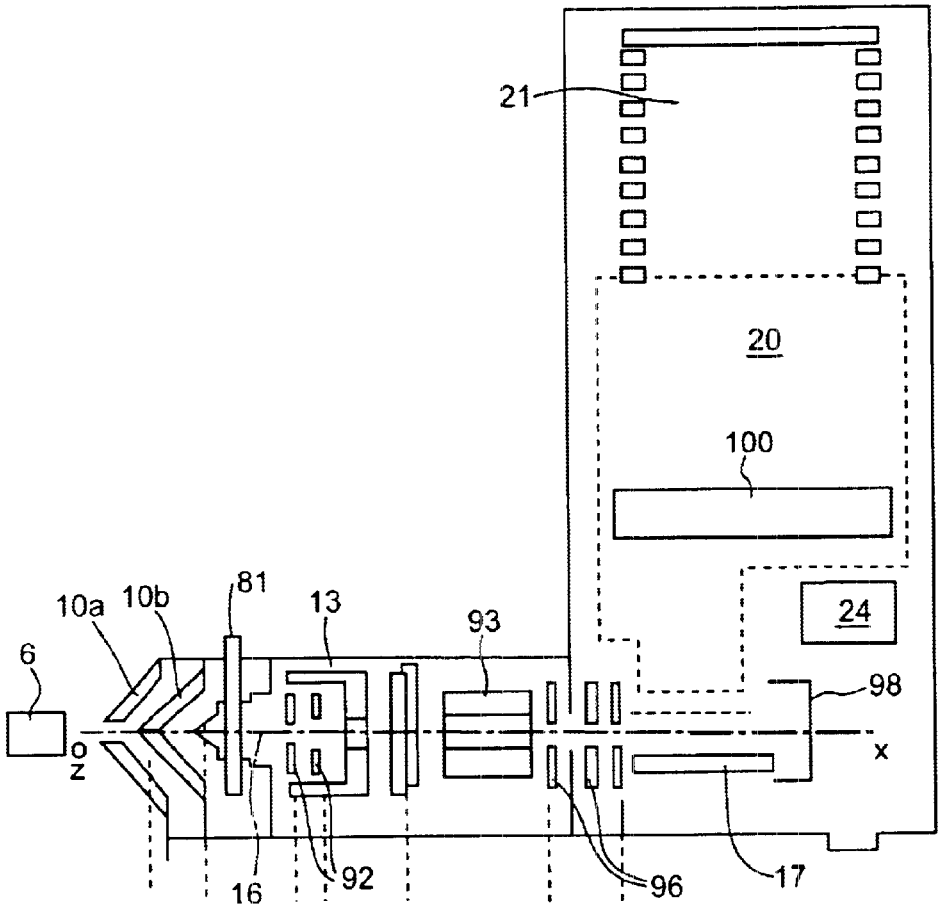
FIG. 6 is a schematic view of part of the spectrometer of FIG. 1 with some components omitted illustrating a further embodiment of the invention.

FIG. 6 is a view of the spectrometer of FIG. 1 with some of the components omitted for ease of illustration. Ion source 6 produces an ion beam as previously described which passes through skimmer cones 10*a* and 10*b* and sliding valve 81 to beam forming optics 13. The beam forming optics form the beam into a beam suitable for entry into orthogonal accelerator 17 so that beam packets can be pushed sideways by the accelerator 17 into liner 20 for reflection by ion mirror 21 back to the detector 24 as previously described.

Figure 7:
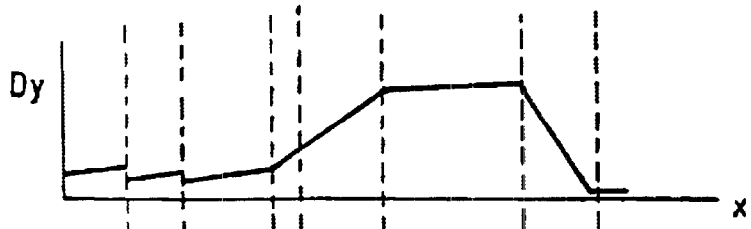
FIG. 7 is a graph showing a focussed ion beam dimension according to the embodiment of FIG. 6.
Figure 8:
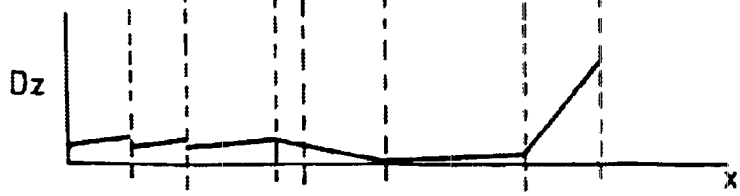
FIG. 8 is a graph showing another dimension of the beam showing in the graph of FIG. 7.

The beam forming optics focuses the ion beam 16 so that the beam has a dimension in one direction which is substantially greater than the dimension in another direction. For example as is shown by graphs which form the subject of FIG. 7 and 8 the beam 16 is focussed by plates 92 so as to have a dimension in the "Y" direction (which is the vertical direction in FIG. 6) which is much greater than the dimension in the "Z" direction (which is the direction into and out of the plane of the paper of FIG. 6). For example, the dimension in the "Y" direction may be in the order of 30 mm and the dimension in the "Z" direction may be in the order of 3 mm. The beam passes through a restrictor 93 to further beam forming and focussing plates 96 which refocus the beam to effectively cause the beam to cross over so that the "Z" dimension becomes large and the "Y" dimension becomes small for application of the beam into the orthogonal accelerator 17. The cross over of the beam which has a large dimension in one direction and a small dimension in another direction as distinct from merely focussing to a circular point, reduces the space charge effect of the beam because a large number of ions are not present in a small space at any one time thereby reducing charge de-focussing of the beam as the beam crosses over as it is focussed by the beam forming optics. The beam therefore as a significant dimension in the "Z" direction as it enters the orthogonal accelerator for push out into the liner 20.

In this embodiment and the embodiment of FIG. 1 a collector electrode 28 is arranged at the end of the orthogonal accelerator for collecting ions which pass through the orthogonal accelerator 17.

As the beam packets are pushed out of the orthogonal accelerator 17 into the liner 20 a vertical focussing means 100 is provided to produce vertical focussing of the beam to return the "Z" dimension of the beam to a smaller size suitable for receipt by the detector 24. That is, the "X" dimension of the "Z" dimension of the beam packets pushed out of the orthogonal accelerator 17 will be somewhat larger than the size of the detector 24 and in order to ensure that all the ions are received by the detector 24 the vertical focussing means 100 reduces the "Z" dimension of the beam to a size suitable for receipt by the detector 24. The vertical focussing means 100 may be positioned anyway in the liner 20 as shown in FIGS. 1 and 6 but preferably positioned at a point where ions of different masses have already separated in time so that the space charge effects are less severe when the beam is re-focussed and crosses over and becomes smaller after vertical focussing.

Figure 9:
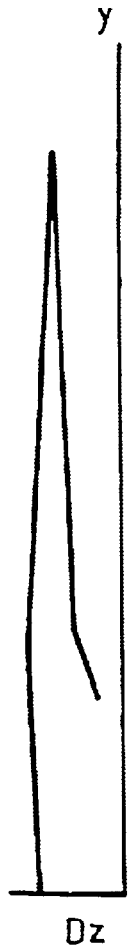
FIG. 9 is a graph showing the beam dimension after vertical focussing in the embodiment of FIG. 6.

FIG. 9 shows how the "Z" dimension changes during vertical focussing to reduce the beam to a size suitable for receipt by the detector 24.

Figure 10:
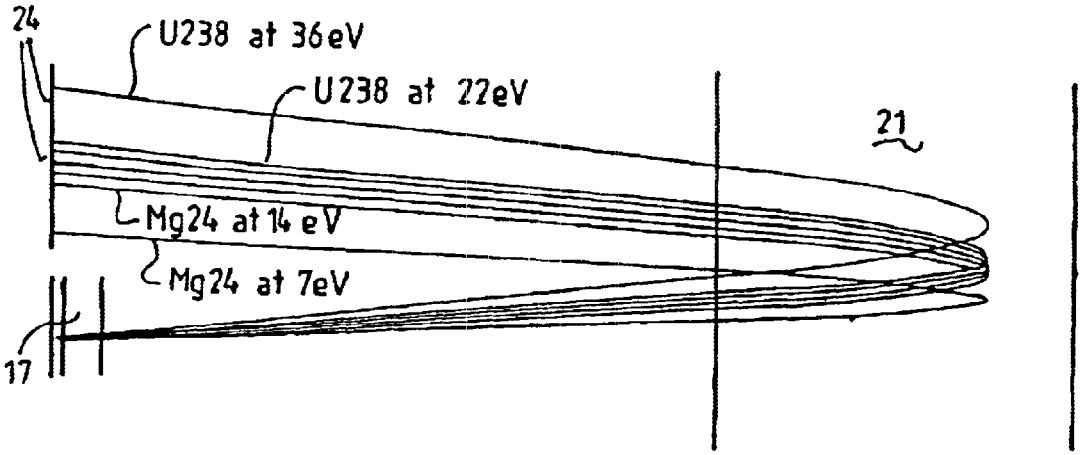
FIG. 10 is a diagram illustrating the operation of a conventional orthogonal accelerator.
Figure 11:
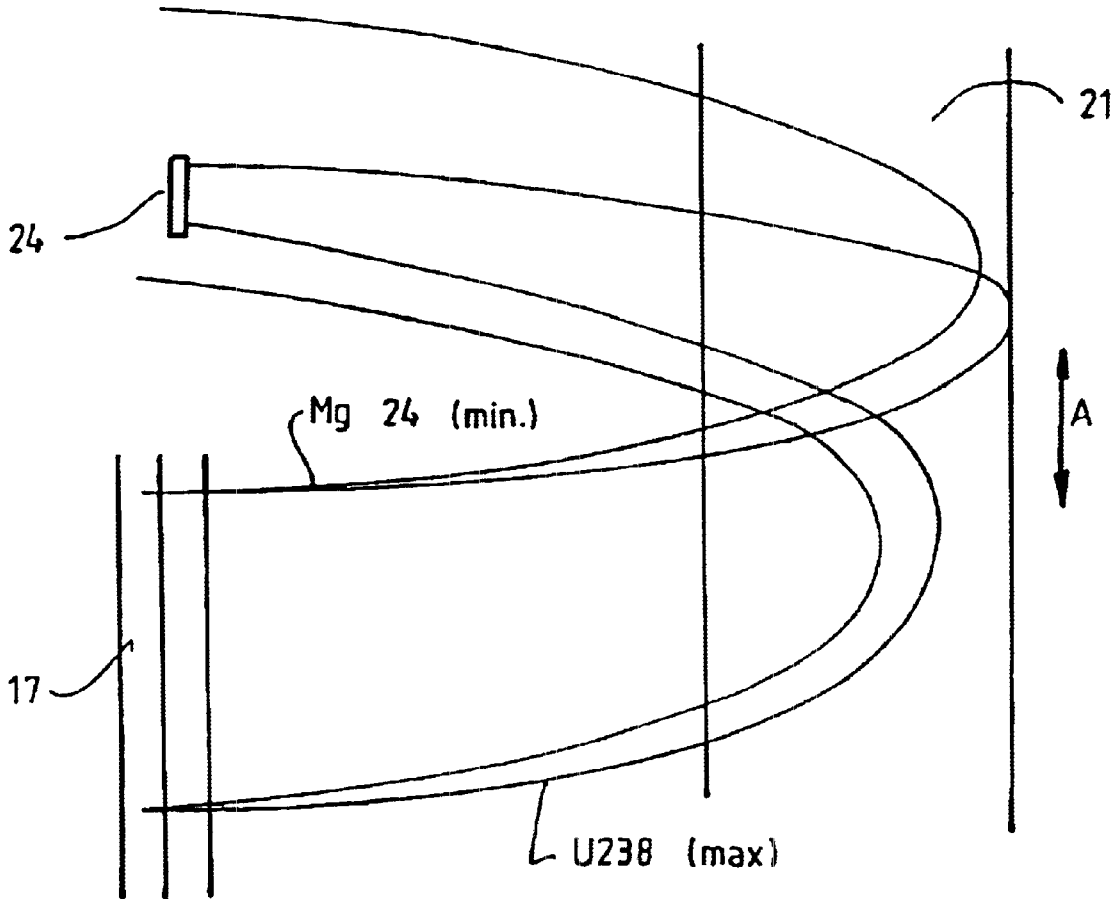
FIG. 11 is a diagram showing an orthogonal accelerator and detector arrangement according to an embodiment of the invention.

FIGS. 10 and 11 illustrate a further embodiment of the invention in which the length of the orthogonal accelerator 17 in the direction of the ion beam is greater than the size of the detector 24.

FIG. 10 demonstrates how ions of different masses reach the detector 24 at different points due to the difference in average longitudinal energy. Extreme cases of, for example, magnesium 24 at a minimal energy of 7 electron volts and uranium 238 at a maximum energy of 36 electron volts are shown. In order for the detector 24 to receive these ions emanating from the same point in the orthogonal accelerator 17, the detector would have to have a size of approximately 68 mm. Typical detector sizes are in the order of 30 mm or less and therefore many of the ions deflected sideways by the orthogonal accelerator are not received by the detector 24 and therefore the duty cycle or orthogonal acceleration is relatively low.

FIG. 11 shows an arrangement whereby the orthogonal accelerator 17 is increased in length relative to the detector 24 so that the orthogonal accelerator is in the order of 1.5 to 3 times the size of the detector 24 and most preferably approximately 2 to 3 times the size of the detector 24. In this embodiment, low energy and low mass ions extruded at one extremity of the orthogonal accelerator 17 such as Mg 24 ions can be received by the detector 24 and high energy high mass ions extruded at the other extremity of the orthogonal accelerator 17 are also received by the detector 24. Ions with masses and energies between those of the magnesium 24 and uranium 238 ions referred to above and produced between the extremities of the orthogonal accelerator 17 shown in FIG. 11 will also arrive at the detector 24. Although the fraction of ions lost for detection may be the same as in the prior art arrangements, the overall number of ions reaching the detector 24 is increased due to the fact that more ions are initially extracted from the orthogonal accelerator 17. Thus, the detector 24 according to this arrangement has the ability to detect ions having a wider spread of longitudinal energy therefore increasing the duty cycle of the orthogonal acceleration and therefore increasing the sensitivity of the spectrometer.

The detector 24, according to this embodiment of the invention, is preferably positioned relative to the orthogonal accelerator 17 to a compromised position so that most of the overlapped ion projectories cross the detector plane of the detector 24 at its entrance window. In order to adjust the position at which the ions leaving the orthogonal accelerator 17 will intersect with the detector 24 the initial energy supplied to the ion beam entering the orthogonal accelerator 17 can be altered so that the ion trajectory shown in FIG. 11 will effectively move in the direction of double headed arrow A in FIG. 11. Typically, the energy may be in the order of 20 volts, but by increasing or decreasing this voltage, the trajectories can move in the direction of double headed arrow A to provide optimum intersection of the trajectories with the detector 24.

In one preferred embodiment of the invention, the detector 24 would have an effective length of approximately 30 mm and the orthogonal accelerator an effective length of approximately 50 mm.

Spatial focusing to focus ions produced at different positions in an ion beam entering the orthogonal accelerator will be described with reference to FIGS. 11 to 21 and in particular illustrates how parameters of the orthogonal accelerator can be set to achieve minimal peak width for a beam of finite initial width.

The condition of first-order time-spatial focusing in conventional TOF was introduced by Wiley and McLaren in the 50's. They stated that the change in the time of flight ΔT corresponding to a small change of initial coordinate s is given by series expansion:

$$\Delta T = \sum_{n=1}^{\infty} \frac{1}{n!}\left(\frac{d^n T}{ds^n}\right)_{s_0} (\Delta s)^n \tag{1}$$

Then the condition of first order spatial focusing was stated as:

$$\left(\frac{dT}{ds}\right)_{s_0} = 0 \tag{2}$$

Best resolution was observed for those configurations in which drift time T(S) at S=S0 has maximum. Later can be achieved by employment the condition:

$$\left(\frac{d^2 T}{ds^2}\right)_{s_0} < 0. \tag{3}$$

In practice beam width W can be of the order of (0.5–1) $S_{max}$ ($S_{max}$ being the width of the first gap of the three stage acceleration), and (1) should be changed to:

$$\Delta T = \frac{1}{W}\cdot\int_{S=So+W/2}^{S=So-W/2}\sum_{n=1}^{\infty}\left|\frac{1}{n!}\left(\frac{d^n T}{ds^n}\right)_S (\Delta s)^n\right| dS. \tag{4}$$

Even the equality of the derivatives of all the orders to zero at S0 is not enough to keep overall _T minimal. In the other points of the beam these derivatives can sufficiently differ from zero, and (4) will not be minimized.

The condition of ideal spatial focusing at such a case can be formulated as following:

$$\int_{s_0-w/2}^{s_0+w/2}\sum_{n=1}^{\infty}\left|\frac{1}{n!}\frac{d^n T}{ds^n}(\delta s)^n\right| ds = 0, \tag{5}$$

$S_0$ is coordinate of the centre of ion beam

W is full width of the ion beam

Figure 12:
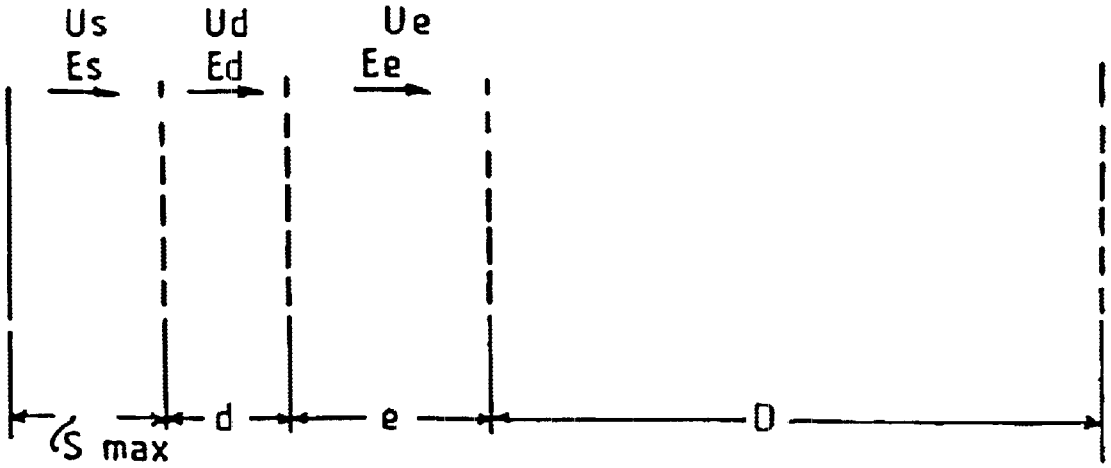
FIG. 12 is a diagram of an orthogonal accelerator used in spatial focusing to spatially focus ions moved sideways from different points in an incoming ion beam.

Consider typical three-step acceleration as shown in FIG. 12. Two-step acceleration configuration can be simply created by applying the condition of $E_s=E_d$. Maximal total energy of ions, i.e. the total drop of potential $U_s+U_d+U_e$ is supposed to stay constant. As in our consideration maximal _S=W can be of the order of S, the total drift energies of ions differ sufficiently. In order to keep possible turn-around time influence the same, let consider Es the same for all configurations.

Formula for derivative $d^nT/ds^n$ for 3-step configuration is derived to be;

$$\frac{d^n T}{ds^n} = \left(\frac{2m}{e}\right)^{1/2}\cdot\left(\frac{E_s}{2}\right)^n\cdot(-1)^n\cdot \left\{|2n-3|!s^{1/2-n}E_s^{-1/2-n} + E_d^{-1}(B^{1/2-n}-C^{1/2-n}) + E_e^{-1}(A^{1/2-n}-B^{1/2-n}) - \frac{D}{2}(2n-1)!A^{-1/2-n}\right\}, \tag{6}$$

where $A=sE_s+dE_d+eE_e$; $B=sE_s+dE_d$; $C=sE_s$; (2n−3)! and (2n−1)! are factorials of odd numbers only. S is a variable coordinate of a particular point in the beam measured from the first grid in the orthogonal accelerator.

For 3-step acceleration the equation becomes:

$$D=2\cdot\{((s_0+\Delta s)^{1/2}-(s_0-\Delta s)^{1/2})\cdot E_s^{-1/2}+E_d^{-1}\cdot(B_+^{1/2}-C_+^{1/2}-B_-^{1/2}+C_-^{1/2})+E_e^{-1}\cdot(A_+^{1/2}-B_+^{1/2}-A_-^{1/2}+B_-^{1/2})\}\cdot(A_-^{-1/2}-A_+^{-1/2})^{-1}, \tag{7}$$

where indexes −, + mean that value of correspondent parameter A, B or C is considered at $S=_{S0}-W/2$, $S=S_0+W/2$ respectively, D is distance to special focus from exit of orthogonal accelerator e is gap width of third gap of the 3-step acceleration d is gap width of second gap of the three-step acceleration Es, Ed and Ee are the field strengths of the first, second and third stages of the three stage acceleration respectively.

As is shown in FIG. 1 a rotary pump 11 is used for primary evacuation of the interface chamber 10 and the first low pressure turbo pump 14 evacuates intermediate chamber 12. The rotary pump 11 is connected to the interface chamber 10 by a conduit 150 which contains an isolation valve 152 for shutting off the conduit 150. The turbo pump 14 which evacuates the intermediate chamber 12 is also connected to the rotary pump 11 by connecting the output of the turbo pump into the conduit 150 so-that the rotary pump 11 maintains a low pressure on the output of the turbo pump 14 so that turbo pump 14 can evacuate the relative lower pressure from the intermediate chamber 12.

A second turbo pump 30 is coupled to the main chamber 29. A third turbo pump 31 is connected to an additional chamber defined between the intermediate chamber 12 and the main chamber 29. The turbo pump 30 has its output connected to turbo pump 31 by conduit 154 to maintain low pressure on the upward side of the pump 30. The output of turbo pump 31 is connected to rotary pump 11 by a conduit 158 which includes an admission valve 156.

The third turbo valve 31 evacuates the additional chamber between the intermediate chamber 12 and the main chamber 29 thus, the turbo pump 31 is able to reduce the pressure in the intermediate chamber 159 and also serves to reduce the output side pressure of the turbo pump 30 which evacuates the already relatively low pressure in the chamber 20. The pump 31 therefore reduces the pressure on the outlet side of the turbo pump 30 to a sufficiently low level whereby it can extract gas from the chamber 20 to reduce the chamber 20 to the desired low operating pressure.

A baffle 158 may be provided between the additional chamber and the main chamber 29 the baffle 154 has an opening 158 for allowing the ion beam to pass from the additional chamber 159 into the orthogonal accelerator 17.

The inclusion of the third turbo pump enables the size of all of the pumps to be reduced thereby greatly decreasing the cost of the pumps not withstanding the fact that additional pump is required.

Since modifications within the spirit and scope of the invention may readily be effected by persons skilled within the art, it is to be understood that this invention is not limited to the particular embodiments described by way of example hereinabove.

What is claimed is:

1. A time of flight analysis device, including:

means for producing a ion beam and for directing the ion beam in a first direction;

a first orthogonal accelerator for directing some of the ions in the ion beam transverse to the first direction into a time of flight cavity;

a second orthogonal accelerator;

an ion mirror for reflecting ions in the beam which pass through the first orthogonal accelerator and the second orthogonal accelerator back in to the second orthogonal accelerator, so the second orthogonal accelerator can push the reflected ions transverse to the first direction into the time of flight cavity; and a detector for detecting the ions after the ions pass along the time of flight cavity.

2. The device of claim 1, wherein the first and second orthogonal accelerators are separate from one another and accelerating and focussing means is provided between the first and second orthogonal accelerators.

3. A time of flight analysis device, including:

means for producing an ion beam;

a time of flight cavity;

orthogonal accelerator means for receiving the ion beam and for deflecting the ion beam sideways into the time of flight cavity;

an ion mirror at one end of the time of flight cavity for receiving the deflected ion beam and reflecting the deflected ion beam;

a detector for receiving the reflected ions; and a second ion mirror arranged transversed with respect to the first ion mirror for reflecting at least some of the reflected ions from the first mirror to the detector.

4. The device of claim 3, wherein the second ion mirror extends from said one end of the time of flight cavity to the detector which is arranged at a first end of the flight cavity adjacent the orthogonal accelerator.

5. A time of flight analysis device, including:

means for producing an ionised sample from which a beam of ions is generated;

an orthogonal accelerator for deflecting the ion beam sideways, the orthogonal accelerator being configured and powered so that ions of the same charge to mass ratio which are moved sideways from the beam of ions and commence sideways movement from different distances within the beam in the direction of sideway movement are time and spatially focused at a focus position, the spatial focussing being performed according to the following conditions for finite spatial spread $$\int_{s_0-w/2}^{s_0+w/2}\sum_{n=1}^{\infty}\left|\frac{1}{n!}\frac{d^nT}{ds^n}(\delta s)^n\right|ds=0, \tag{5}$$

$S_0$ is coordinate of the ion beam

W is the full width of the ion beam; and a detector for detecting the beam which is deflected sideways by the orthogonal accelerator.

6. The device of claim 5, wherein the detector is located at the focus position.

7. The device of claim 5, wherein the orthogonal accelerator is a two or three plate accelerator.

8. The device of claim 5, wherein for three plate and therefore three stage focussing the spatial focussing is performed according to the following conditions $$D=2\cdot\{((s_0+\Delta s)^{1/2}-(s_0-\Delta s)^{1/2})\cdot E_s^{-1/2}+E_d^{-1}\cdot(B_+^{1/2}-C_+^{1/2}-B_-^{1/2}+C_-^{1/2})+E_e^{-1}\cdot(A_+^{1/2}-B_+^{1/2}-A_-^{1/2}+B_-^{1/2})\}\cdot(A_-^{-1/2}-A_+^{-1/2})^{-1}, \tag{7}$$

where $A=sE_s+dE_d+eE_e$;

$B=sE_s+dE_d$;

$C=sE_s$ indexes −, + mean that value of correspondent parameter A, B or C is considered at $S=S_0-W/2$, $S=S_0+W/2$ respectively, D is distance to special focus from exit of orthogonal accelerator e is gap width of third gap of the 3-step acceleration d is gap width of second gap of the three-step acceleration Es, Ed and Ee are the field strengths of the first, second and third stages of the three stage acceleration respectively.

9. A time of flight analysis device, including:

means for producing an ionised sample from which a beam of ions is generated;

an orthogonal accelerator for deflecting the ion beam sideways;

beam forming optics between the means for producing the ionised sample and the orthogonal accelerator for focussing the beam of ions so that at every focus plane the beam is focussed such that one dimension of the beam is larger than another dimension of the beam;

a detector for detecting the ion beam deflected sideways by the orthogonal accelerator; and vertical focussing means between the orthogonal accelerator and the detector for focussing the beam back to a size commensurate with the size of the detector.

10. The device of claim 9, wherein the beam forming optics focus the beams at every focus plane between the means for producing the ionised sample and the orthogonal accelerator, the beam has a dimension of about 30 mm by 3 mm.

11. The device of claim 9, wherein the vertical focussing means is located at a position where ions of different masses are separated in time so that space charge effects are less severe when the beam crossover becomes smaller after vertical focussing.

12. A time of flight analysis device, including:

means for producing an ionised sample from which a beams of ions is generated;

an orthogonal accelerator for deflecting the ion beam sideways for producing ion packets, the ions in each packet separating as the ions in each packet move sideways due to different mass charge ratios of the ions in each packet; and vertical focusing means located at a position where the ions in the ion packet have separated in time, for vertically focusing the ions which have been separated so as to avoid excessive space charge effects.

* * * * *